US006491562B1

(12) United States Patent
Jackson

(10) Patent No.: US 6,491,562 B1
(45) Date of Patent: Dec. 10, 2002

(54) AUTOMATION DESIGNING KIT

(75) Inventor: Susan Jackson, London (GB)

(73) Assignee: T & R Scenery West Inc., North Hollywood, CA (US)

( * ) Notice: Subject to any disclaimer, the term of this patent is extended or adjusted under 35 U.S.C. 154(b) by 0 days.

(21) Appl. No.: 09/691,984

(22) Filed: Oct. 19, 2000

(51) Int. Cl.[7] ..... A63H 33/00

(52) U.S. Cl. ..... 446/71; 446/72; 446/73; 446/75; 446/76; 446/77; 446/85; 446/102; 446/104; 446/118

(58) Field of Search ..... 446/71, 72, 73, 446/75, 76, 77, 118, 352, 102, 103, 104, 119, 308, 309, 310, 97, 99, 303, 335

(56) References Cited

U.S. PATENT DOCUMENTS 1,789,095 A * 1/1931 Berger
3,037,779 A * 6/1962 Duncan
4,027,424 A 6/1977 Kilroy, Jr. et al. ..... 46/116
4,052,813 A * 10/1977 Crain et al.
4,453,340 A * 6/1984 Kozuka et al.
4,804,348 A 2/1989 Bondi ..... 446/83
4,864,879 A 9/1989 Hou ..... 74/50
4,867,730 A 9/1989 Lee ..... 446/353
4,890,828 A * 1/1990 Hou
4,939,944 A * 7/1990 Hou
6,146,234 A * 11/2000 Yang

* cited by examiner

*Primary Examiner*—Derris H. Banks
*Assistant Examiner*—Ali F Abdelwahed
(74) *Attorney, Agent, or Firm*—Tarolli, Sundheim, Covell, Tummino & Szabo L.L.P.

(57) ABSTRACT

A kit that can be assembled to make a moving toy comprises a container having at least one wall portion movable between a closed position closing an opening in the container and an open position allowing access to the inside of the container through the opening. A shaft supported for rotation relative to the container has a first portion disposed within the container. A plurality of mechanical parts are selectively locatable on the first portion of the shaft to be supported for rotation with the shaft relative to the container. A plurality of design parts are provided for location outside the container. The kit includes structure for connecting at least one of the mechanical parts on the shaft to at least one of the design parts thereby to transfer rotational force from the shaft to the design parts to move the design parts relative to the container.

15 Claims, 4 Drawing Sheets

AUTOMATION DESIGNING KIT

BACKGROUND OF THE INVENTION

The present invention relates to an automaton designing kit, that is, a kit from which one can design and assemble a plurality of different mechanical moving toys.

SUMMARY OF THE INVENTION

The present invention is a kit that can be assembled to make a moving toy. The kit comprises a container having at least one wall portion movable between a closed position closing an opening in the container and an open position allowing access to the inside of the container through the opening. A shaft is supported for rotation relative to the container and has a first portion disposed within the container. A plurality of mechanical parts are selectively locatable on the first portion of the shaft to be supported for rotation with the shaft relative to the container. A plurality of design parts are provided for location outside the container. The kit includes structure for connecting at least one of the mechanical parts on the shaft to at least one of the design parts thereby to transfer rotational force from the shaft to the design parts to move the design parts relative to the container. The plurality of design parts includes a plurality of different design parts that can be assembled separately into a plurality of different toy structures each of which is adapted to be movable upon rotation of the shaft. The first portion of the shaft comprises an outer shaft part and an inner shaft part received within the outer shaft part, the outer shaft part supporting the plurality of mechanical parts, the outer shaft part rotating with the inner shaft part upon rotation of the inner shaft part.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DETAILED DESCRIPTION OF THE INVENTION

Figure 1:
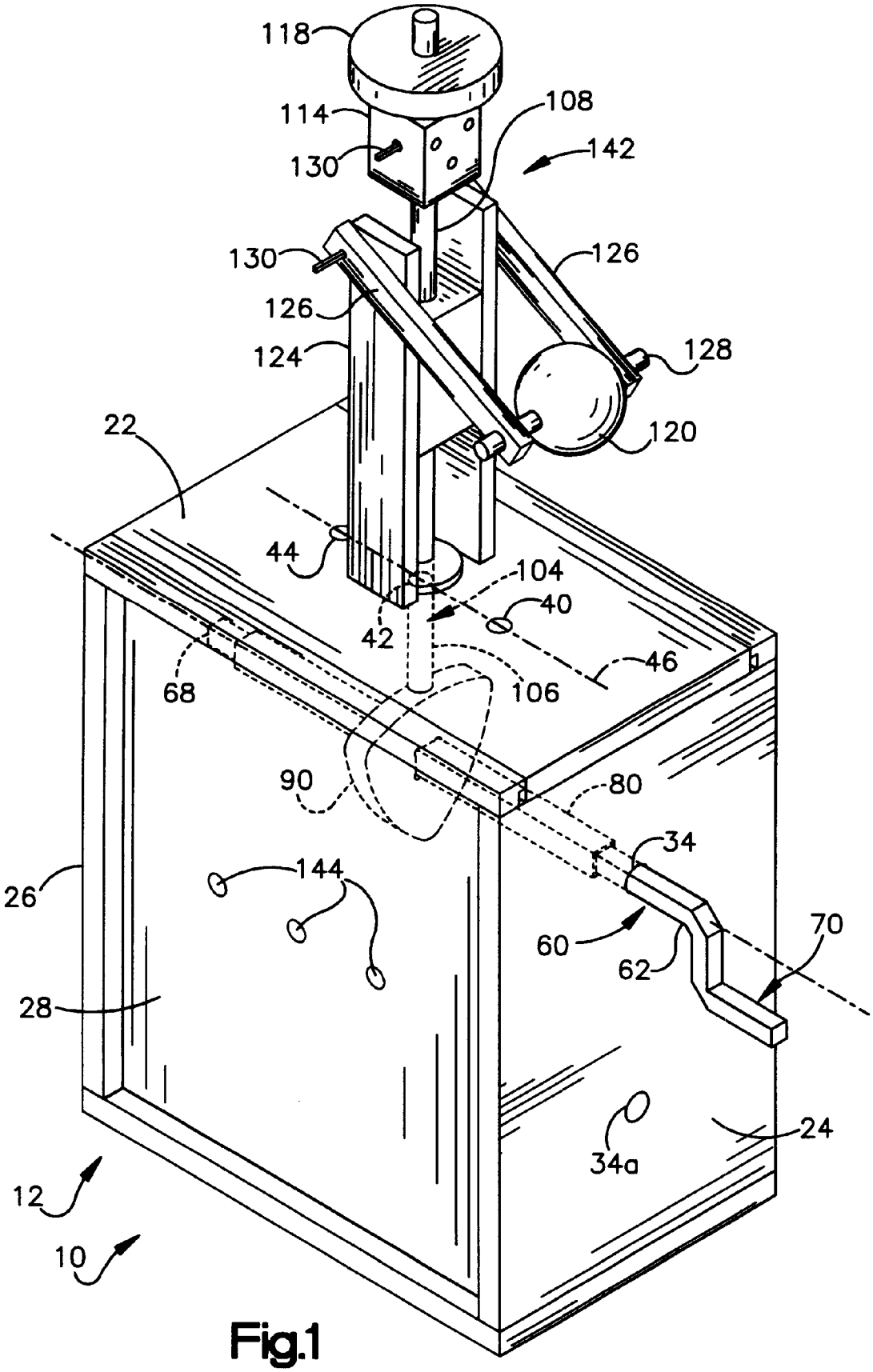
FIG. 1 is a perspective view of an automaton designing kit in accordance with the invention, including box and a moving toy assembled on top of the box.

The present invention relates to an automaton designing kit, that is, a kit from which one can design and assemble a plurality of different mechanical moving toys. As representative of the invention, FIG. 1 illustrates a kit 10.

The kit 10 includes a container 12. The container 12 contains some or, preferably, all of the other parts of the kit 10 when the kit is unassembled. The container 12 also serves to support the other parts of the kit 10 that are in use when portions of the kit are assembled into a moving toy. The container 12, in the illustrated embodiment, is a box, although it could have other configurations.

The box 12 is a rectangular structure having a bottom wall 20, a top wall 22, first and second side walls 24 and 26, a front wall 28, and a back wall 30. The first and second side walls 24 and 26 of the box 12 have first and second shaft openings 34 and 36, respectively. The first and second shaft openings 34 and 36 define an axis 38. The first and second shaft openings 34 and 36 are located the same predetermined distance from the back wall 30 of the box 12.

The top wall 22 of the box has three tappet openings 40, 42 and 44 spaced apart along a line 46. The line 46 of the tappet openings 40–44 is located directly above the axis 38 when the box 12 is oriented vertically, and extends parallel to the axis.

At least one of the walls of the box 12 is removable from the box. In the illustrated embodiment, the front wall 28 of the box 12 is removable by sliding out of tracks 48. The front wall 28 may alternatively be hinged, or may be releasable by magnetic catch. When the front wall 28 is removed, an opening 50 in the box is formed. A chamber 52 in the box 12 is accessible through the opening 50.

The kit 10 includes a shaft 60. The shaft 60 includes an inner shaft 62 and an outer shaft 80.

The inner shaft 62 has an elongate configuration including a central portion 64 and first and second opposite end portions 66 and 68.

The first end portion 66 of the inner shaft 62 extends through the first shaft opening 34 in the first side wall 24 of the box 12 and projects from the first side wall of the box. The second end portion 68 of the inner shaft 62 extends through the second shaft opening 36 in the second side wall 26 of the box 12 and projects from the first side wall of the box. The central portion 64 of the inner shaft 62 is disposed within the chamber 52 in the box 12.

The first end portion 66 of the inner shaft 62 is formed as a handle 70 and includes three sections 72, 74 and 76 set at right angles to each other with the one section 76 being offset from and parallel to the central portion 64 of the inner shaft 62. Thus, the handle 70 is manually engageable to transmit rotational force to the central portion 64 of the inner shaft 62.

The inner shaft 62 has a square cross-sectional configuration for its entire length. The inner shaft 62 is narrow enough, or thin enough, to fit through the shaft openings 34 and 36 in the box side walls 24 and 26.

The outer shaft 80 has an elongate, tubular configuration. The length of the outer shaft 80 is slightly less than the interior width of the box 12, that is, the distance between an inner side surface 82 of the first side wall 24 and an inner side surface 84 of the second side wall 26. As a result, the outer shaft 80 is movable through the opening 50 in the box 12 that is formed when the front wall 28 of the box is removed from the box frame.

The outer shaft 80 has a square cross-sectional configuration with an outer surface. The outer shaft 80 is too wide, or thick, to fit through the shaft openings 34 and 36 in the side walls 24 and 26 of the box 12.

A square central opening or passage 86 extends the length of the outer shaft 80. The outer shaft 80 fits over the inner shaft. Specifically, the central opening 86 in the outer shaft 80 receives the central portion 64 of the inner shaft 62. The interfitting square configurations of the inner and outer shafts 62 and 80 enables rotational force to be transmitted from the central portion 64 of the inner shaft 62, to the outer shaft 80.

The kit 10 includes a plurality of mechanical parts in the form of cams. The cams are individual pieces that may be selectively located on the outer shaft. The cams include, in the illustrated embodiment, a triangular cam 90, an oval cam 92, a round cam 94, and a snail cam 96. Others may be provided of different designs, and/or more than one of a particular design.

Each one of the cams 90–96 has a square central opening 97 by which the cam may be fitted over the square outer shaft 80. When one of the cams 90–96 is fitted on the outer shaft 80, the cam is supported on the outer shaft for rotation with the outer shaft.

The kit 10 includes a plurality of mechanical parts in the form of tappets. The illustrated kit includes three tappets 100, 102 and 104. The tappets 100–104 are pieces that transfer the rotary motion of the shaft 60 and cams 90–96 into reciprocating movement of the tappets in a direction generally perpendicular to the top wall 22 of the box 12.

The tappets 100–104, in the illustrated embodiment, are solid cylindrical rods. The tappets 100–104 have inner end portions 106 that are engageable with (ride on) the cams 90–96. The tappets 100–104 have outer end portions 108 that project through the tappet openings 40–44 in the top wall 22 of the box 12.

The kit 10 includes a group 110 of design figure pieces. The design figure pieces are individual pieces that may be selectively assembled on the top of the box 12, and connected with the outer end portions 108 of the tappets 100–104, to form a movable toy.

The design figure pieces can be of many different shapes and sizes. In the illustrated embodiment, a large number of design figure pieces are provided. These include: Two large blocks 112; four small blocks 114; and one trapezoidal block 116. Also, two discs 118; four large balls 120; and four small balls 122. Also, one U-frame 124; two square connector blocks 126; three round connector pins 128; eleven small connector pins 130; and one cylinder block 131.

At least some of the design figure pieces 112–130 include portions adapted, in a known manner, for connection with the outer end portions of the tappets. For example, each one of the large blocks 112 has a through hole 132 enabling the outer end portion 108 of one of the tappets 100–104 to pass completely through the block 112.

Enough design figure pieces are provided in the group 110 so that a large plurality of different moving toys can be assembled. Many toys can be assembled that have parts that can be moved by at least two of the tappets 100–104, thus providing a substantial degree of movement within the toy.

The kit 10 also includes a number of miscellaneous connection pieces. The connection pieces include washers 134 and rings 136, for example, for securing the other parts of the kit 10 in a working relationship when they are assembled.

The kit 10 is assembled by removing the front wall 28 of the box 12 and clearing the chamber 52 of the box of the other parts. The box 12 is placed so that the bottom wall 20 is resting horizontally on a surface, such as a table top.

One or more of the cams 90–96 are selected and placed on the outer shaft 80. The sub-assembly of the outer shaft 80 and cams 90–96 is moved through the opening 52 into the chamber 50 in the box 12. The outer shaft 80 is aligned along the axis 38.

The second end portion 68 of the inner shaft 62 is then inserted into the chamber 52 through the first shaft opening 34. The second end portion 68 of the inner shaft 62 is inserted into the passage 86 in the outer shaft 80 until it extends from the outer shaft, and through the second shaft opening 36 in the second side wall 26 of the box 12. The second end portion 68 of the inner shaft 62 projects out of the box 12 through the second shaft opening 36. One of the connection pieces, such as a ring 136, may be placed on the projecting second end portion 68 of the inner shaft 62 to prevent the inner shaft from disengaging from the box 12.

At this point, the shaft 60 is supported on the box 12 for rotation relative to the box. Specifically, the first end portion 66 of the inner shaft 62 is supported on the first side wall 24 of the box 12, and the second end portion 68 of the inner shaft 62 is supported on the second side wall 26 of the box. The outer shaft 80, which is fitted over the central portion 64 of the inner shaft 62, is rotatable with the inner shaft about the axis 38. The central portion 64 of the inner shaft 62 is disposed within the chamber 52 in the box 12, together with the outer shaft 80.

The selected cams 90–96 are positioned axially along the outer shaft 80 so that they are underneath the tappet openings 40–44. one or more of the tappets 100–104 are then inserted through the tappet openings 40–44 in the top wall 22 of the box 12. The inner end portions 106 of the tappets 100–104 engage (ride on) the cams 90–96. As a result, the tappets 100–104 reciprocate (are movable vertically up and down) upon rotation of the shaft 60 about the axis 38.

Figure 2:
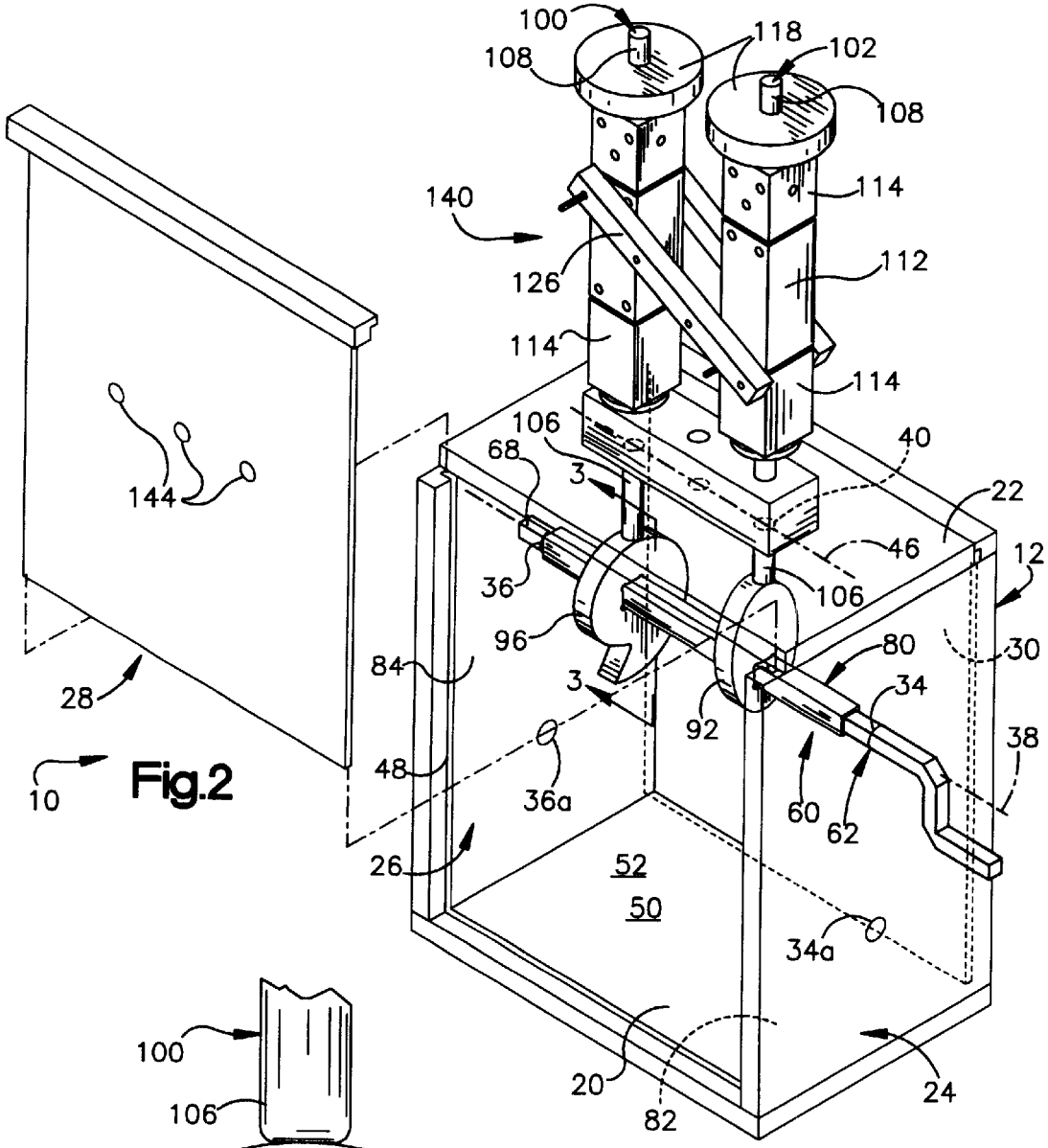
FIG. 2 is a view similar to FIG. 1 showing the kit of FIG. 1 in an assembled condition with a different moving toy assembled on top of the box (shown in phantom) and having the front panel removed to show interior parts of the kit.
Figure 3:
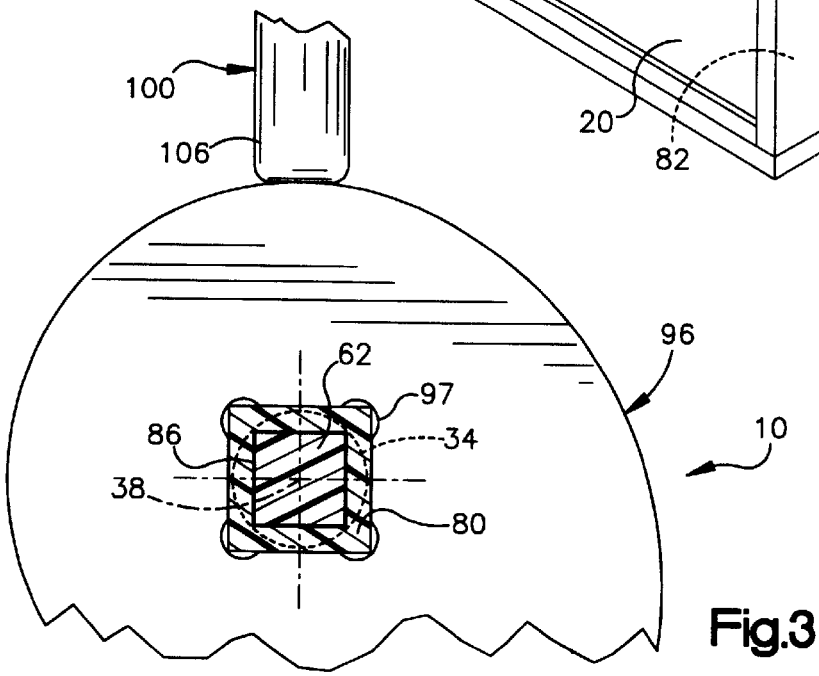
FIG. 3 is an enlarged view taken generally along line 3—3 of FIG. 2 showing a portion of a cam and a shaft of the kit.
Figure 4:
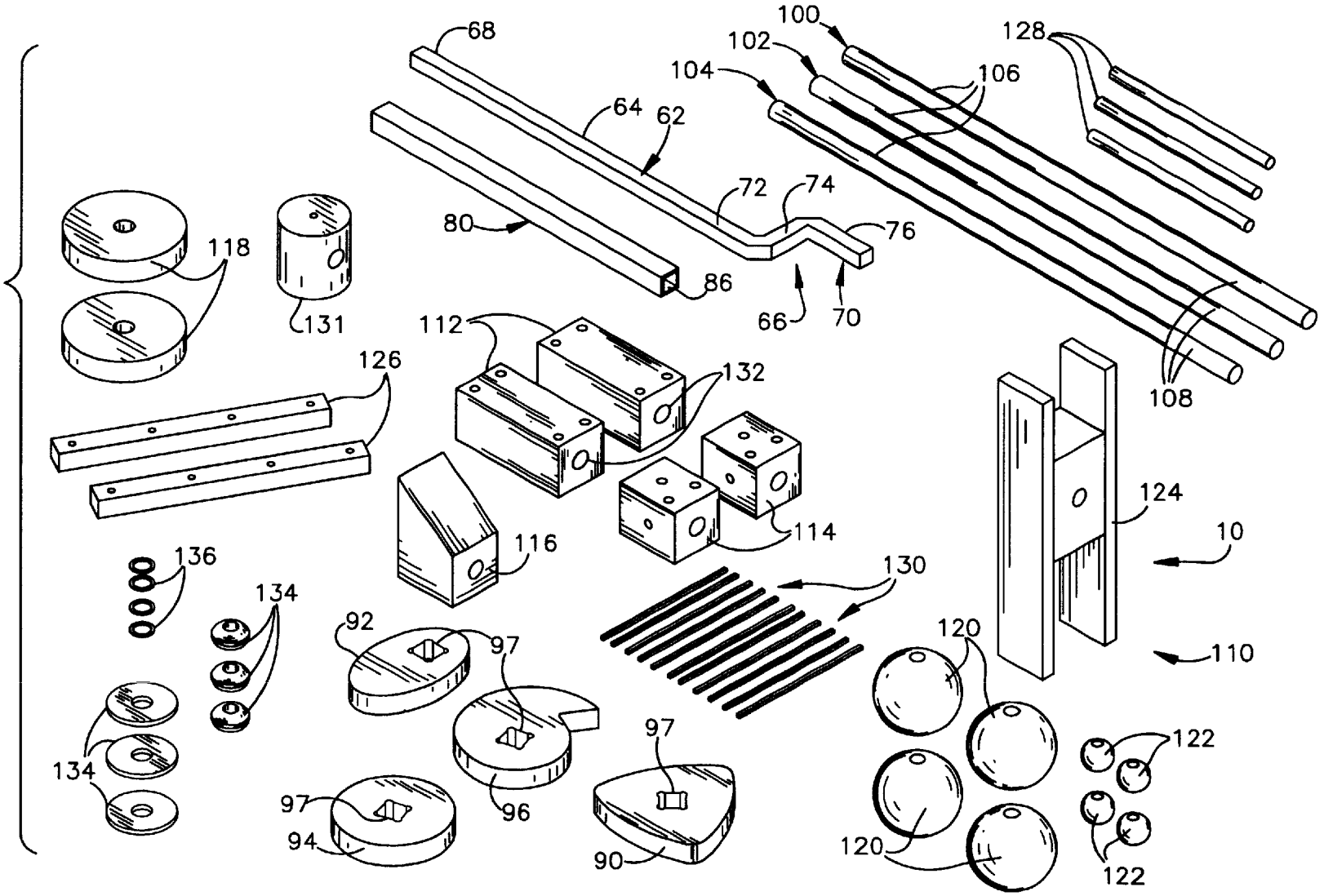
FIG. 4 is a pictorial view of a plurality of elements that form part of the kit of FIG. 1.

Design figure pieces from the group 110 are then selected to build one of the plurality of moving toys that may be made from the group of design figure pieces that are provided with the kit 10. FIG. 2 illustrates a moving toy 140 made from selected ones of the group of design figure pieces. The toy 140 uses two tappets 100 and 102 to move the toy. Numerous other moving toys can be made from the group 110 of design figure pieces, other than the one toy 140 illustrated in FIG. 2. For example, FIG. 1 illustrates a moving toy 142 that uses only one tappet 104 to move the toy.

The handle 70 of the inner shaft 62 is manually engaged by the operator, and rotated about the axis 38. The entire shaft 60 rotates about the axis 38. The rotation of the shaft 60 is transmitted through the cams 90–96 into the tappets 100–104. The tappets 100–104 reciprocate. The reciprocating motion of the tappets 100–104 is transmitted into the design figure pieces 112–130. The design figure pieces 112–130 move, thus animating the moving toy.

Options for the kit include providing the side walls 24 and 26 with a second set of shaft openings 34*a* and 36*a*, and providing the front wall 28 with tappet openings 144. When the box 12 is laid on its back (FIG. 5), two shafts can be inserted through the two sets of shaft openings in the side walls 24 and 26. Tappets can be assembled to project upward through the tappet openings 144 in the front wall 28. Thus, two separate drive shafts can be used simultaneously.

Figure 5:
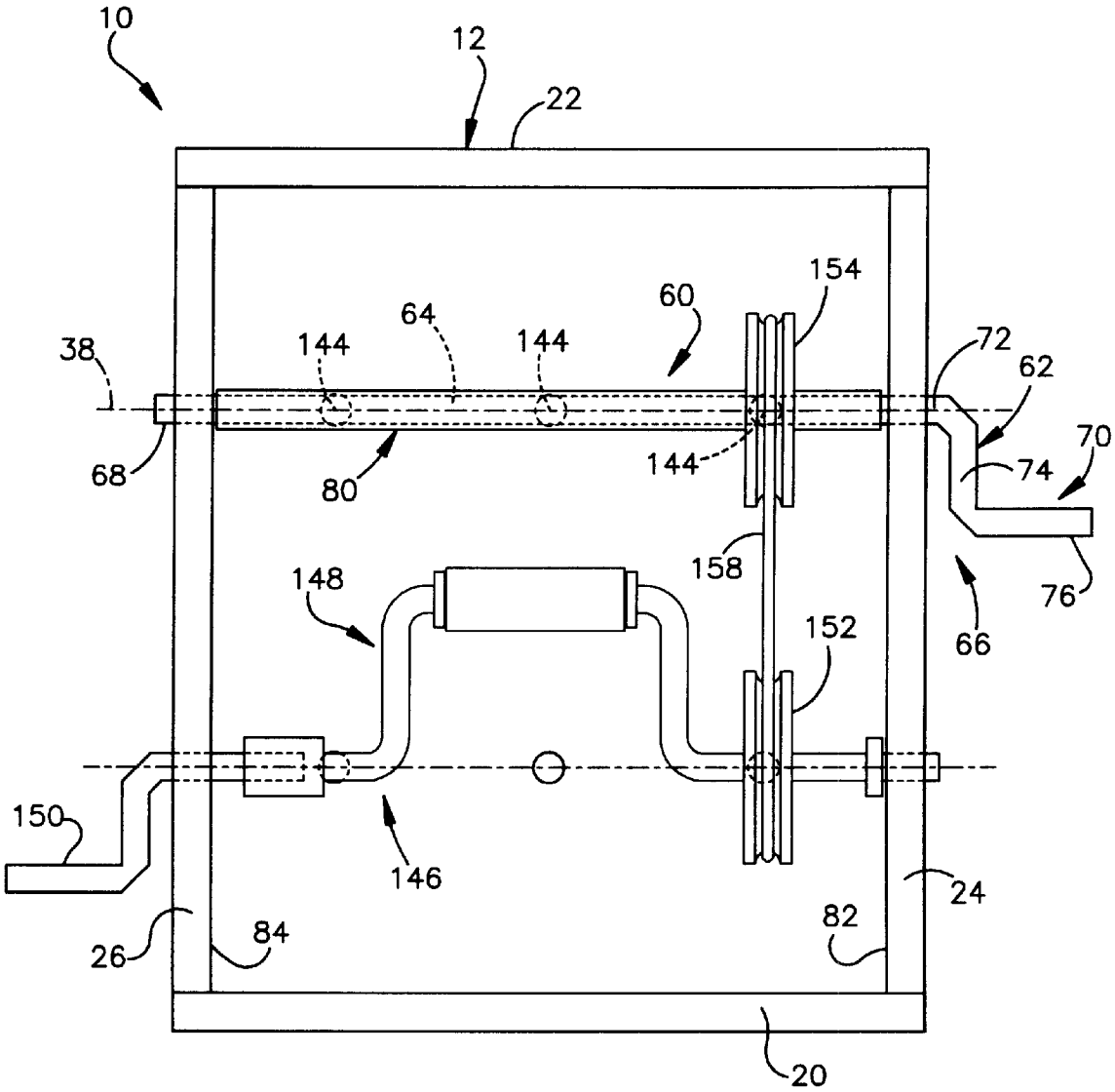
FIG. 5 is a plan view of the kit of FIG. 1 shown in a different condition of assembly.

Additionally, other shaft configurations can be provided, such as the crank shaft 146 shown in FIG. 5. Because of the presence of the U-shaped central section 148, the crank shaft has a detachable handle 150 that is plugged into the central section. A pulley 152 is mounted on the crank shaft 146 and another pulley 154 on the shaft 60. A belt 158 is trained around the pulleys 152 and 154, so that the shafts 146 and 60 rotate together.

From the above description of the invention, those skilled in the art will perceive improvements, changes and modifications in the invention.

Having described the invention, I claim:

1. A kit that can be assembled to make a moving toy, said kit comprising:

a container having at least one wall portion movable between a closed position closing an opening in said container and an open position allowing access to the inside of said container through said opening;

a shaft supported for rotation relative to said container and having a first portion disposed within said container;

a plurality of mechanical parts selectively locatable on said first portion of said shaft to be supported for rotation with said shaft relative to said container;

a plurality of design parts for location outside said container; and means for connecting at least one of said mechanical parts on said shaft to at least one of said design parts thereby to transfer rotational force from said shaft to said design parts to move said design parts relative to said container;

wherein said first portion of said shaft comprises an inner shaft part that can be received within an outer shaft part, said outer shaft part supporting said plurality of mechanical parts and being movable with said mechanical parts, during assembly of said kit into said moving toy, through said opening, when said inner shaft part is not received within said outer shaft part.

2. A kit as set forth in claim 1 wherein said inner shaft part is supported on said container for rotation relative to said container and has a manually engageable portion for receiving force to rotate said shaft, said outer shaft part transmitting rotational force from said inner shaft part to said mechanical parts.

3. A kit that can be assembled to make a moving toy, said kit comprising:

a container having at least one wall portion movable between a closed position closing an opening in said container and an open position allowing access to the inside of said container through said opening;

a shaft supported for rotation relative to said container and having a first portion disposed within said container;

a plurality of mechanical parts selectively locatable on said first portion of said shaft to be supported for rotation with said shaft relative to said container;

a plurality of design parts for location outside said container; and means for connecting at least one of said mechanical parts on said shaft to at least one of said design parts thereby to transfer rotational force from said shaft to said design parts to move said design parts relative to said container;

wherein said plurality of design parts including a plurality of different design parts that can be assembled separately into a plurality of different toy structures each of which is adapted to be movable upon rotation of said shaft.

4. A kit that can be assembled to make a moving toy, said kit comprising:

a container supporting a shaft for rotation relative to said container, said shaft having a first portion disposed within said container;

a plurality of mechanical parts selectively locatable on said first portion of said shaft to be supported for rotation with said shaft relative to said container;

a plurality of design parts for location outside said container; and means for connecting at least one of said mechanical parts on said shaft to at least one of said design parts thereby to transfer rotational force from said shaft to said design parts to move said design parts relative to said container;

said plurality of design parts including a plurality of different design parts that can be assembled separately into a plurality of different toy structures each of which is adapted to be movable upon rotation of said shaft.

5. A kit as set forth in claim 4 wherein said means for connecting comprises a plurality of tappets that are supported on said mechanical parts for reciprocating movement in response to rotation of said shaft, said kit being adapted to support at least two tappets at a time for reciprocating movement, to move different at least two different design parts of said moving toy simultaneously.

6. A kit as set forth in claim 4 wherein said container has at least one wall portion movable between a closed position closing an opening in said container and an open position allowing access to the inside of said container through said opening, a portion of said shaft being movable through said opening together with said plurality of mechanical parts during assembly of said kit into said moving toy.

7. A kit as set forth in claim 4 wherein said first portion of said shaft comprises an outer shaft part and an inner shaft part received within said outer shaft part, said outer shaft part supporting said plurality of mechanical parts, said outer shaft part rotating with said inner shaft part upon rotation of said inner shaft part.

8. A kit as set forth in claim 7 wherein said container has at least one wall portion movable between a closed position closing an opening in said container and an open position allowing access to the inside of said container through said opening, said outer shaft part being movable through said opening, together with said plurality of mechanical parts on said first shaft portion, during assembly of said kit into said moving toy, when said inner shaft part is not received within said outer shaft part.

9. A kit that can be assembled to make a moving toy, said kit comprising:

a container supporting a shaft for rotation relative to said container, said shaft having a first portion disposed within said container;

a plurality of mechanical parts selectively locatable on said first portion of said shaft to be supported for rotation with said shaft relative to said container;

a plurality of design parts for location outside said container; and means for connecting at least one of said mechanical parts on said shaft to at least one of said design parts thereby to transfer rotational force from said shaft to said design parts to move said design parts relative to said container;

said first portion of said shaft comprising an outer shaft part and an inner shaft part received within said outer shaft part, said outer shaft part supporting said plurality of mechanical parts, said outer shaft part rotating with said inner shaft part upon rotation of said inner shaft part.

10. A kit as set forth in claim 9 wherein said container has at least one wall portion movable between a closed position closing an opening in said container and an open position allowing access to the inside of said container through said opening, said outer shaft part being movable through said opening, together with said plurality of mechanical parts on said first shaft portion, during assembly of said kit into said moving toy, when said inner shaft part is not received within said outer shaft part.

11. A kit as set forth in claim 10 wherein said outer shaft and said inner shaft each have a square cross-sectional configuration where disposed within said container.

12. A kit as set forth in claim 9 wherein said means for connecting comprises a plurality of tappets that are supported on said mechanical parts for reciprocating movement in response to rotation of said shaft, said kit being adapted to support at least two tappets at a time for reciprocating movement, to move different at least two different design parts of said moving toy simultaneously.

13. A kit as set forth in claim 12 wherein said plurality of design parts comprises a plurality of different design parts that can be assembled separately into a plurality of different toy structures each of which is adapted to be movable upon rotation of said shaft.

14. A kit as set forth in claim 9 wherein said container has first and second opposite wall portions, said first portion of said shaft being disposed in said container between said first and second wall portions, said shaft having first and second opposite end portions projecting from said first portion of said shaft, said first end portion of said shaft extending through a first opening in said first wall portion of said container, said second end portion of said shaft extending through a second opening in said second wall portion of said container.

15. A kit as set forth in claim 14 wherein said first end portion of said shaft is configured as a manually engageable handle to receive rotational force to rotate said shaft.

* * * * *